US006128364A

United States Patent [19]

Niemann

[11] Patent Number: 6,128,364

[45] Date of Patent: Oct. 3, 2000

[54] CONDENSER-MONOCHROMATOR ARRANGEMENT FOR X-RADIATION

[75] Inventor: Bastian Niemann, Goettingen, Germany

[73] Assignee: Leica Microsystems Lithography GmbH, Jena, Germany

[21] Appl. No.: 09/101,468

[22] PCT Filed: Jan. 10, 1997

[86] PCT No.: PCT/DE97/00033

§ 371 Date: Jul. 10, 1998

§ 102(e) Date: Jul. 10, 1998

[87] PCT Pub. No.: WO97/25722

PCT Pub. Date: Jul. 17, 1997

[30] Foreign Application Priority Data

Jan. 10, 1996 [DE] Germany ..... 196 00 701
Aug. 18, 1996 [DE] Germany ..... 196 33 047

[51] Int. Cl.[7] ..... G21K 1/06; G21K 7/00

[52] U.S. Cl. ..... 378/43; 378/84; 378/85

[58] Field of Search ..... 378/43, 84, 85, 378/145

[56] References Cited

U.S. PATENT DOCUMENTS

| | | | |
|---|---|---|---|
| 5,177,774 | 1/1993 | Suckewer et al. | 378/43 |
| 5,199,057 | 3/1993 | Tamura et al. | 378/43 |
| 5,204,887 | 4/1993 | Hayashida et al. | 378/43 |
| 5,222,113 | 6/1993 | Thieme et al. | 378/43 |
| 5,311,565 | 5/1994 | Horikawa | 378/43 |
| 5,361,292 | 11/1994 | Sweatt | 378/34 |
| 5,848,119 | 12/1998 | Miyake et al. | 378/43 |
| 6,023,496 | 2/2000 | Kuwabara | 378/45 |
| 6,028,911 | 2/2000 | Kawahara | 378/45 |

FOREIGN PATENT DOCUMENTS

| | | |
|---|---|---|
| 0 475 098 A2 | 8/1991 | European Pat. Off. . |
| 0 475 098 A3 | 8/1991 | European Pat. Off. . |

OTHER PUBLICATIONS

"X–ray microscopy studies", G. Schmahl et al., May 1993, pp. 95–102.

"Soft X–Ray Imaging Zone Plates with (illegible) Zone Numbers for Microscopic and Spectroscopic Applications," B. Niemann et al., Optics Communications, vol. 12, No. 2, Oct. 1974, pp. 160–163.

"Quantitative Mikroskopie and Mikrstrukturierung," Andreas Schlachetzki und Klaus Dorenwendt, ISBN 3–89429–686–0, pp. 97–116, Sep. 1995.

"X–ray Microscopy," Professor Dr. Ping–Chn Cheng and Professor Dr. Gwo–Jen Jan, ISBN 3–540–18148–2 Springer–Verlag Berlin Heidelberg New York, pp. 32–39, 1987.

*Primary Examiner*—David V. Bruce
*Assistant Examiner*—Drew A. Dunn
*Attorney, Agent, or Firm*—Foley & Lardner

[57] ABSTRACT

The description relates to high-transmission condenser-monochromator arrangements providing quasi-monochromatic object illumination and incoherent imaging in X-ray microscopes (5) and are particularly suitable for well-collimated beams from undulators on electron storage rings. As the deflecting optical component, the condenser-monochromator arrangements comprise an off-axis zone plate in transmission (7) or reflection. There is a monochromator diaphragm (11) in the object plane. The exposure aperture of the condenser-monochromator arrangement may be variably set by means of simple plane mirrors (2). The off-axis zone plate (7) and at least one plane mirror (2) are rotated about the optical axis 6 of the X-ray microscope (5) during exposure. In addition, there are fixed elements containing a focusing device with a focusing ring and a downstream system on one or two hollow conical mirrors.

11 Claims, 7 Drawing Sheets

CONDENSER-MONOCHROMATOR ARRANGEMENT FOR X-RADIATION

BACKGROUND OF THE INVENTION

The invention relates to a condenser-monochromator arrangement for X-ray radiation in accordance with the features in the preamble of claim 1.

In X-ray microscopy, substantial progress has been made over recent years in the wavelength region of approximately 0.2–5 nm. X-ray microscopes have been developed which are being operated using brilliant X-ray sources. Said X-ray sources include electron storage rings whose deflecting magnets and undulators are sources of intensive X-ray radiation; there have not so far been other X-ray sources of comparable brilliance. To date only the X-ray radiation generated by deflecting magnets has been used for transmitting X-ray microscopes.

At present, only microscope zone plates are used as highly resolving objectives in X-ray microscopes. Microscope zone plates are rotational symmetrical circular transmission gratings with grating constants which decrease outward, and typically have diameters of up to 0.1 mm and a few hundred zones. The numerical aperture of a zone plate is determined very generally by the diffraction angle at which the outer, and thus finest zones diffract vertically incident X-ray beams. The achievable spatial resolution of a zone plate is determined by its numerical aperture. Over recent years, it has been possible for the numerical aperture of the X-ray objectives used to be substantially increased, with the result that their resolution has improved. This trend to higher resolution will continue.

Object illumination of hollow conical shape is generally required for X-ray microscopes which use zone plates as X-ray objectives. Otherwise, the radiation from the zero and the first diffraction orders of the condenser zone plate would also overlap the image at its center. The reason for this is that the overwhelming proportion of the radiation which falls onto the object in a fashion parallel or virtually parallel to the optical axis penetrates said object and the following microscope zone plate (the diffracting X-ray objective) without being diffracted and is seen as a general diffuse background in the direction straight ahead, that is to say in the center of the image field. For this reason, all transmitting X-ray microscopes use annular condensers, and the useful region, not diffusely overexposed region, of the image field becomes larger the larger the inner, radiation-free solid angle region of the condenser.

It is known from the theory of microscopy that the numerical aperture of the illuminating condenser of a transmitted-light microscope should always be approximately matched to the numerical aperture of the microscope objective, in order also to obtain an incoherent object illumination from incoherently radiating light sources, and thus to obtain a virtually linear relationship between object intensity and image intensity. If the aperture of the condenser, by contrast, is less than that of the microscope objective, a partially coherent image is present, and the linear transformation between object intensity and image intensity is lost for the important high spatial frequencies, which determine the resolution of the microscope.

To date, "large-area" annular zone plates have been used as condensers for X-ray radiation. (A. Schlachetzki, K. Dorenwendt: Quantitative Mikroskopie und Mikrostrukturierung [Quantitative microscopy and microstructuring], block seminar from Sep. 13 to 14, 1995, Physikalisch Technische Bundesanstalt, Technische Universität Braunschweig [Federal Engineering Institute, Braunschweig Technical University], published: PTB-Opt-50, Braunschweig, March 1996, pages 98–116, B. Niemann et al., "X-Ray Microscopy" (see FIG. 3); P. C. Cheng, G. J. Jan: X-ray Microscopy, Springerverlag Berlin Heidelberg 1987, pages 32–38, W. Meyer-Ilse et al., "Status of X-ray Microscopy Experiments at the BESSY Laboratory" (see FIG. 3.1)). They focus the X-ray radiation onto the object to be investigated using the X-ray microscope. The size of such a "condenser zone plate" is matched to the beam diameter, which is typically up to 1 cm at the end of the beam tube of a deflecting magnet of an electron storage ring. Since the condenser zone plate is annular, it captures approximately ¾ of the radiation situated in said beam diameter. Since the focal length of a zone plate is the reciprocal of the wavelength used, such a condenser zone plate acts together with a small so-called monochromator pinhole diaphragm, which is situated in the object plane about the object, simultaneously as a linear monochromator (Optics Communication 12, pages 160–163, 1974, "Soft X-Ray Imaging Zone Plates with Large Zone Numbers for Microscopic and Spectroscopic Applications", Niemann, Rudolph, Schmahl). Only a narrow spectral region of the incident polychromatic radiation of an electron storage ring is focused into the pinhole diaphragm and used to illuminate the object.

The spectral resolution of such a linear monochromator is $R=D/2d$, if D and d are the diameter of the condenser zone plate and monochromator pinhole diaphragm and if the condenser zone plate images the source region of the X-ray radiation in a strongly reduced fashion. However, the relationship holds only if the image of the source—it being the so-called "critical illumination" which is concerned here—is not larger than the diameter d of the pinhole diaphragm. If R is at least as large as the zone number n of the microscope zone plate of the X-ray microscope, the chromatic aberration of the microscope zone plate is negligible and worsens the quality of the X-ray image only unsubstantially. In order to satisfy the requirement placed on the spectral resolution R, use is always made of a condenser zone plate of not too small a diameter D, with the result that the permitted diameter d of the monochromator pinhole diaphragm is larger than the image of the source.

Since, for practical reasons, the location of an X-ray microscope can never be brought near the source of the X-ray radiation of an electron storage ring and the separation is typically at least 15 m, the area illuminated by the beam can also not undershoot specific values. Consequently, the diameter D of a condenser zone plate capturing as much X-ray radiation as possible should also not undershoot said values. If the numerical aperture of the condenser zone plate is now increased for these conditions of use, there is necessarily a decrease in the focal length of the condenser zone plate. As a result, there is a reduction in the image scale with which the source is imaged into the object plane, and the diameter of the illuminated object region drops (in practice to a diameter of a few $\mu$m), and this is disadvantageous. Only by means of other measures—for example, scanning parallel movements of the condenser and monochromator pinhole diaphragm—is it then possible to ensure that a relatively large object region is homogeneously illuminated. In addition, during the movement, the monochromator diaphragm and condenser zone plate must remain exactly adjusted relative to one another.

Condenser zone plates are normally used at the first diffraction order, at which all condenser zone plates implemented to date have their highest diffraction efficiency. It is difficult in this case to achieve the previously required matching of the numerical aperture of the condenser zone plate to that of the microscope zone plate without coming across new difficulties. In order to realize the matching, the condenser zone plate must have the same fine zones on the outside as does the microscope zone plate itself. The microscope zone plates built with the highest light-gathering power meanwhile have zone widths of only 19 nm (corresponding to a 38 nm period of the zone structures). Zone plates with such fine zone structures can so far be produced only using methods of electron beam lithography, in which the zones are produced successively. Holographic methods, which produce the pattern of a zone plate in one step in a "parallel" fashion and thus in a short time are ruled out, since a suitably shortwave UV holography does not exist. Consequently, it would also be possible to produce condenser zone plates with matched numerical apertures only using methods of electron beam lithography, and this must be described as a serial, and thus slow method. Because of their necessarily large diameter, however, such condenser zone plates typically have several 10,000 zones. The write times with an electron beam lithography system are then of the order of magnitude of weeks, which is unrealistic in practice, for which reason condenser zone plates have to date not been produced using methods of electron beam lithography.

Condenser-monochromator arrangements of even higher light-gathering power are required for dark-field X-ray microscopy (if an absorbing ring, which is to be adjusted very precisely, is not placed in the rear focal plane of the microscope objective). The periods of the zone structures of suitable condenser zone plates would, in turn, need to be less than 38 nm.

A condenser-monochromator arrangement which as far as possible delivers all the X-ray light made available by the beam tube into an annular hollow conical aperture of large aperture angle relative to the object is advantageous for phase-contrast X-ray microscopy.

In order to increase the resolution of the X-ray microscopes, work is presently being carried out on developing microscope zone plates which have a minimum zone width of still only 10 nm. This increases the apertures of the microscope zone plates and, consequently, the required numerical apertures of the condensers, in order to ensure an incoherent object illumination, and the already mentioned difficulties are compounded further.

Electron storage rings which make X-ray radiation available from undulators are under construction, and partly finished, across the globe. Said undulators supply an approximately 10 to 100 times higher X-ray flux, which can be fully used for X-ray microscopy. Moreover, the X-ray radiation is much more effective collimated; the beam at the end of a beam tube typically has a diameter of only 1–2 mm at the location of a microscope, and the "large" condenser zone plates which have been used to date and whose aperture has not been matched can no longer be fully illuminated. In order for condenser zone plates to render the radiation sufficiently monochromatic, it would then be necessary either to use arrangements having the disadvantages already discussed above—smaller condenser zone plates with shorter focal lengths and correspondingly smaller monochromator pinhole diaphragms—or large condenser zone plates must be illuminated in off-axis fashion, that is to say in an edge region. However, such off-axis arrangements illuminate the object obliquely, and this leads to an asymmetric optical transfer function of the microscope, and the images produced thereby can be evaluated only with difficulty. Another avenue which has already been explored consists in suitably expanding the beam by means of an additional zone plate upstream of the condenser. However, this has the disadvantage that further light loss occurs at said additional diffracting element—the diffraction efficiency of zone plates is in the region of only 10% to 20%—and, in addition, there is then a total of three zone plates present in the microscope which, because their focal lengths depend on wavelength, can be adjusted to one another exactly with much more difficulty than two zone plates. Moreover, in the two last-mentioned cases, as well, matching the apertures can disadvantageously be achieved only by matching the smallest zone widths of the condenser zone plate to those of the microscope zone plate.

SUMMARY OF THE INVENTION

It is the object of the invention to specify for quasimonochromatic object illumination in an X-ray microscope and incoherent imaging a condenser-monochromator arrangement which has an annular illuminating pupil, by means of which a high numerical aperture can be produced which is appropriately adapted to the high apertures of a modem X-ray objective with microscope zone plates for producing a high resolution, and by means of which it is also possible to make complete use of a narrow incident beam with a diameter of only a few millimeters.

This object is achieved according to the invention by means of the features specified in the invention as claimed. Advantageous embodiments and developments of the invention follow from the subclaims.

The invention proceeds from the finding that incoherent imaging is obtained when an object to be imaged is successively illuminated from different directions during the exposure time of an image. Use is made of a condenser-monochromator arrangement which comprises an off-axis zone plate, a plane mirror, a monochromator pinhole diaphragm on the optical axis, and a mechanical holder for the off-axis zone plate and the plane mirror. The holder is rotatable about the optical axis of the microscope. An illumination from different directions is produced by said rotation.

Even in the case of only a small beam cross section of the incident X-rays, the condenser-monochromator arrangement contains only a single diffracting optical element, and the latter contains relatively coarse diffracting structures, and thus in total a smaller number of such structures than in previously used optical elements, with the result that the latter can be exposed in distinctly shorter times with the aid of electron beam lithography. Moreover, the illuminating aperture of the condenser-monochromator arrangement can be variably set without the need to use a second diffracting optical element. The useful region of the image field is enlarged, since illumination comprises only a very "thin-walled hollow conical envelope".

DESCRIPTION OF THE DRAWINGS

Diagrammatically represented exemplary embodiments of the invention are-explained in more detail below with the aid of the drawing, in which.

DETAILED DESCRIPTION OF THE INVENTION

Figure 1:
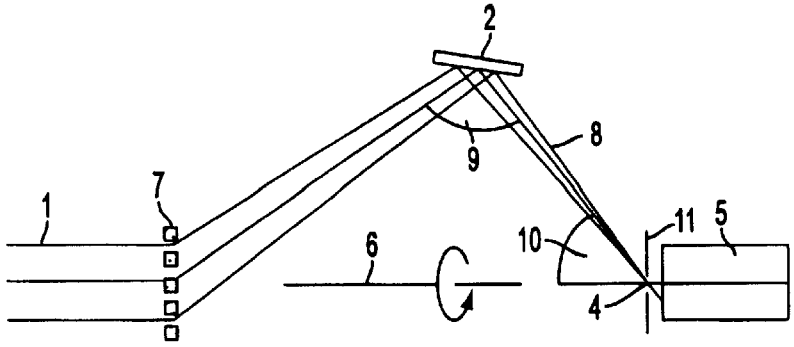
FIG. 1 shows a condenser-monochromator comprising an off-axis transmitting zone plate and a downstream plane mirror.

Represented in FIG. 1 is a condenser-monochromator arrangements [sic] which includes two optical elements. The incident X-ray radiation 1 impinges on a diffracting and, at the same time, imaging optical element 7 and is focused by the latter and diffracted in the direction of a plane mirror 2. The plane mirror 2 is situated a few cm upstream of the focal point of the X-ray radiation and reflects the latter into the monochromator pinhole diaphragm 11 onto the object 4, which is located on the optical axis 6 of the X-ray microscope 5. The plane mirror 2 is at grazing incidence with a few degrees of incidence angle, with the result that total reflection occurs (for soft X-ray radiation, the material has a refraction index which is smaller than one) and a high reflectivity is achieved. There is no need to place any particularly high requirement on the surface quality of the plane mirror 2 with regard to the angle tangent error (an angle tangent error of better than 10 arc seconds is sufficient), since the plane mirror 2 is located only a few cm upstream of the object 4 to be illuminated. As a result, the angle tangent error can expand the illuminated image field only insignificantly by scattering. Since the plane mirror 2 is situated relatively near the focal point of the X-ray radiation and the beam cross section is already small here, the plane mirror 2 favorably needs to be only a few cm long.

As a unit, together the two described optical elements 2, 7 form a condenser-monochromator arrangement with the monochromator pinhole diaphragm 11. The optical elements 2, 7 are mounted rotatably about the optical axis 6 of the X-ray microscope 5. They can be fastened for this purpose in a mechanical holder (not represented here). The holder has a rotation axis which coincides with the optical axis 6 and about which it can rotate together with the optical elements 2, 7. The optical axis 6 of the X-ray microscope 5 is aligned in the direction of propagation of the incident X-ray radiation 1. Because of the high absorption of the soft X-ray radiation used, the entire construction is located in a vacuum chamber.

The diffracting and imaging optical element 7 can be an off-axis zone plate. Here, an off-axis zone plate is understood as a zone plate which consists only of a small, asymmetric, coherent zone region situated remote from the middle of the zone plate. Consequently, the structures inside said zone region are generally not rotationally symmetrical. The zone region is so large in this case that it can capture an X-ray beam with a cross sectional area of a few $mm^2$. It can be used with transmission as an off-axis transmitting zone plate 7 in accordance with FIG. 1, or with reflection as an off-axis reflecting zone plate 3 in accordance with FIG. 6. Since an off-axis zone plate deflects the X-ray radiation laterally, the plane mirror 2 is absolutely necessary in order to retroreflect the X-ray radiation onto the optical axis 6.

If, during the exposure of a microscopic image, which typically amounts to a few seconds, the mechanical holder with the optical elements 7, 2 (FIG. 1) is rotated exactly one revolution about the optical axis 6, the illuminating cone 8 incident obliquely on the object 4 describes a hollow cone which determines the effective aperture of the illumination. The aperture angle 10 of said hollow cone can be set via the angle of reflection 9 of the plane mirror 2. For this purpose, it is also necessary to readjust the spacing of the plane mirror 2 from the optical axis 6 and the position of the off-axis transmitting zone plate 7 (or of the off-axis reflecting zone plate 3 in FIG. 6) along the optical axis 6, so that the focus is again situated exactly on the optical axis 6 in the object 4. The position of the rotation axis of the holder must remain stable to a few $\mu$m, and this can be achieved using spindle ball-bearings or antibacklash ball-bearing slides.

Since the aperture matching is undertaken with the plane mirror 2, there are no special requirements to be set with regard to the strength of the beam deflection by diffraction at the off-axis zone plate 7, 3. The off-axis zone plate 7, 3 need only generate an image of the X-ray radiation source at a suitable size in the object plane and decompose the X-ray radiation spectrally. Since undulators have very small source sizes—they are distinctly smaller than the source sizes in the deflecting magnets used to date—, it is possible to use a smaller reduction scale and thus an off-axis zone plate 7, 3 with a focal length typically at least twice as large as that of the condenser zone plates mentioned in the introduction, in order to illuminate the object with so-called "critical illumination". The consequence of this is that not only is it possible to use an off-axis reflecting zone plate 3 used at grazing incidence (FIG. 6, likewise also FIGS. 8–10), which has coarser zones from the very start, but that an off-axis transmitting zone plate 7 (FIG. 1, likewise also FIGS. 2–4, 11–14) is already sufficient, said plate having coarser, and thus fewer zones than the condenser zone plate discussed above which, in accordance with the prior art, is the optical element (at all) in a condenser-monochromator arrangement for the purpose of quasimonochromatic illumination. In addition, because of the better focused beam the surface to be structured for applications using undulators is typically 10 times smaller than in the case of the condenser zone plate described in the introduction for the radiation from deflecting magnets. In addition, the zone widths of an off-axis zone plate 7, 3 are virtually constant, with the result that they advantageously have a virtually uniformly high dispersion over their entire surface.

As already mentioned, it is possible in principle to use arrangements with off-axis transmitting and reflecting zone plates. An off-axis transmitting zone plate 7 for X-ray radiation with a wavelength of 2.4 nm has, for example, a width of 50 nm and Germanium zones with a height of 300 nm—and this is currently technically feasible to produce. An off-axis reflecting zone plate 3 which is equivalent in terms of its optical properties and is used for incidence angles of a few degrees has, by contrast, zone widths approximately 10 to 50 times larger in conjunction with a simultaneously distinctly smaller zone height. Consequently, the off-axis reflecting zone plate 3 is technically much simpler to realize than the equivalent off-axis transmitting zone plate 7.

As distinguished from an off-axis transmitting zone plate 7, which is produced in a self-supporting fashion with fine supporting structures or on a very thin backing foil, an off-axis reflecting zone plate 3 can be located on a stable solid substrate. Said substrate can be thermally loaded and cooled because of the extremely oblique incidence of the X-ray radiation.

It is also possible with several plane mirrors 2 for both the off-axis transmitting zone plate 7 and the off-axis reflecting zone plate 3 to be arranged in different ways, and this is represented by way of example in FIGS. 2, 3 and 9–14.

Figure 2:
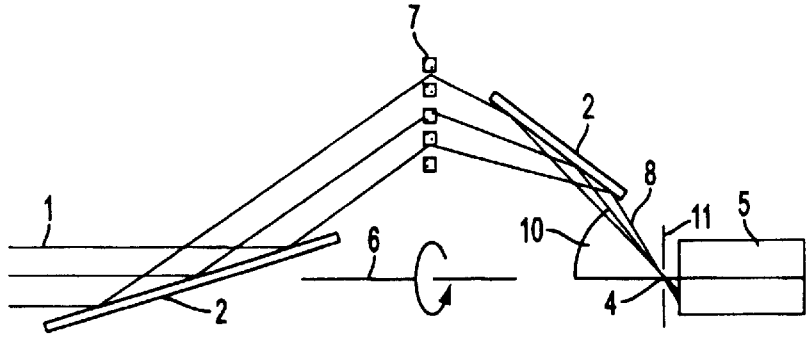
FIG. 2 shows a condenser-monochromator comprising an off-axis transmitting zone plate, and an upstream and a downstream plane mirror.
Figure 9:
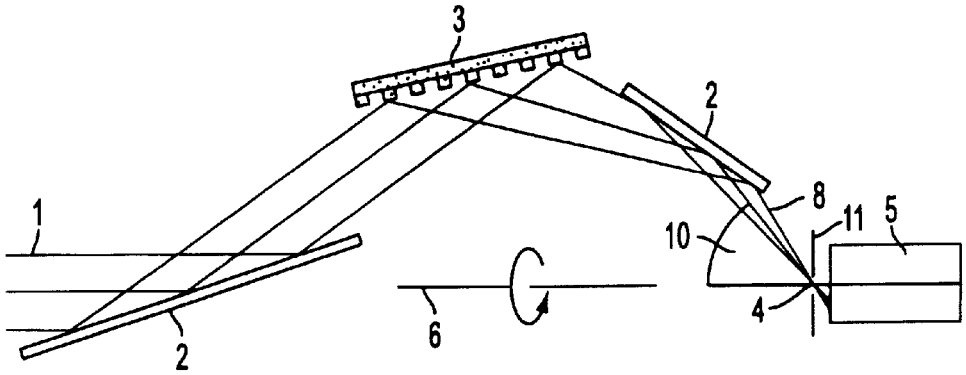
FIG. 9 shows a condenser-monochromator comprising an off-axis reflecting zone plate and an upstream and a downstream plane mirror.

Thus, in accordance with FIG. 2 and also in accordance with FIG. 9 the incident X-ray radiation 1 is firstly deflected by means of a plane mirror 2 from its original direction toward an off-axis zone plate 7, 3. Downstream of the off-axis zone plate 7, 3, a second plane mirror 2 reflects the diffracted and converging radiation in the direction of the optical axis 6, it being possible to use said second plane mirror 2 to set the aperture of the illumination. Use is made of an off-axis transmitting zone plate 7 in accordance with FIG. 2, and of an off-axis reflecting zone plate 3 in accordance with FIG. 9. The arrangement of the two plane mirrors 2 and the off-axis zone plate 7, 3 is rotated by one revolution about the optical axis 6 during the exposure time for an X-ray image. The illuminating cone 8, which is incident obliquely on the object, describes a hollow cone which determines the effective aperture of the illumination. The desired aperture matching is performed by means of the second plane mirror 2, which is arranged downstream of the off-axis zone plate 7, 3 in the beam path, by setting the angle of reflection 9 suitably.

Figure 3:
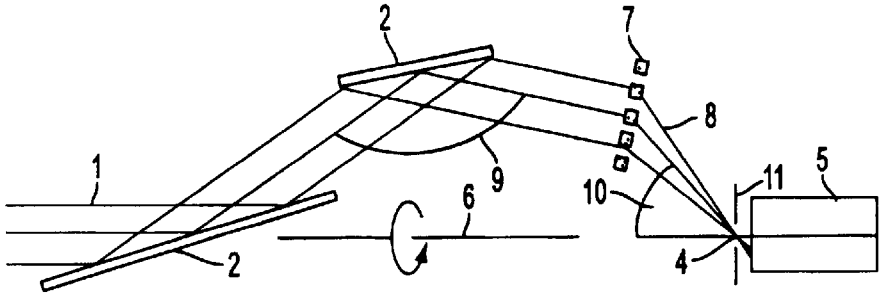
FIG. 3 shows a condenser-monochromator comprising an off-axis transmitting zone plate and two upstream plane mirrors.
Figure 10:
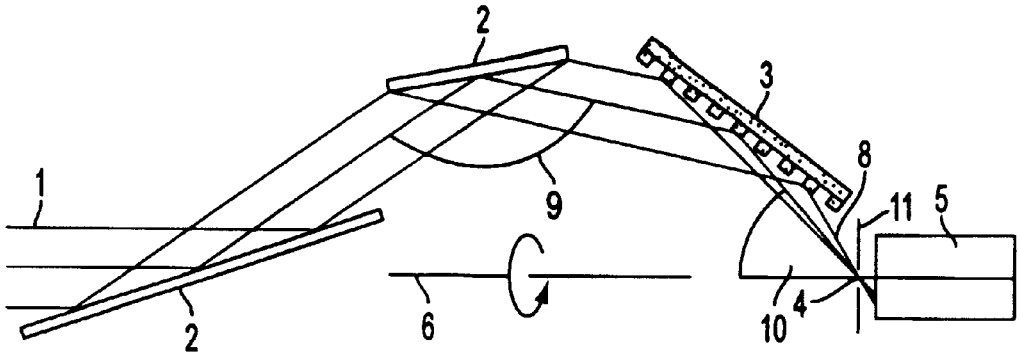
FIG. 10 shows a condenser-monochromator comprising an off-axis reflecting zone plate and two upstream plane mirrors.

In accordance with FIG. 3 and also in accordance with FIG. 10, the incident X-ray radiation 1 is firstly deflected by means of a plane mirror 2 from its original direction and impinges on a second plane mirror 2. From there, it passes in accordance with FIG. 3 to an off-axis transmitting zone plate 7 or, in accordance with FIG. 10 to an off-axis reflecting zone plate 3. The off-axis zone plate 7, 3 focuses the X-ray light into the object 4. The described arrangement of the two plane mirrors 2 and the off-axis zone plate 7, 3 is rotated one revolution about the optical axis 6 with the aid of a mechanical holder (not represented) during the exposure time of the X-ray microscope 5. The illuminating cone 8, which is incident obliquely on the object 4, describes a hollow cone which determines the effective aperture of the illumination. The desired aperture matching is performed by means of the second plane mirror 2, which is arranged in the beam path shortly upstream of the off-axis zone plate 7, 3, by appropriately setting the angle of reflection 9.

Figure 4:
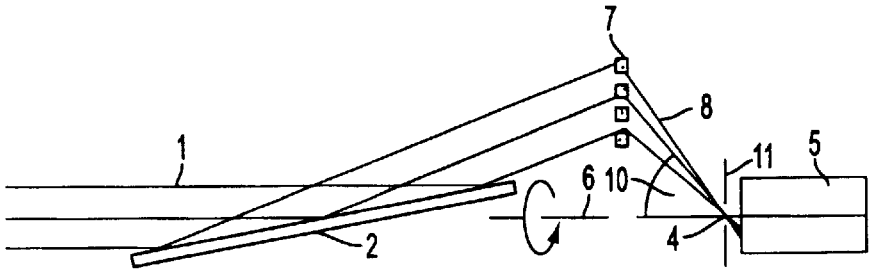
FIG. 4 shows a condenser-monochromator comprising an off-axis transmitting zone plate and an upstream plane mirror.

FIG. 4 shows a condenser-monochromator arrangement with an off-axis transmitting zone plate 7 and a downstream plane mirror 2. The off-axis transmitting zone plate 7 focuses the X-ray light obliquely back to the object 4 onto the optical axis 6. The off-axis transmitting zone plate 7 and the upstream plane mirror 2 are rotated one revolution about the optical axis 6 during the exposure time of the X-ray microscope 5. The illuminating cone 8, which is incident obliquely on the object, describes a hollow cone which determines the effective aperture of the illumination. However, flexible aperture matching is no longer possible with this arrangement.

Figure 5:
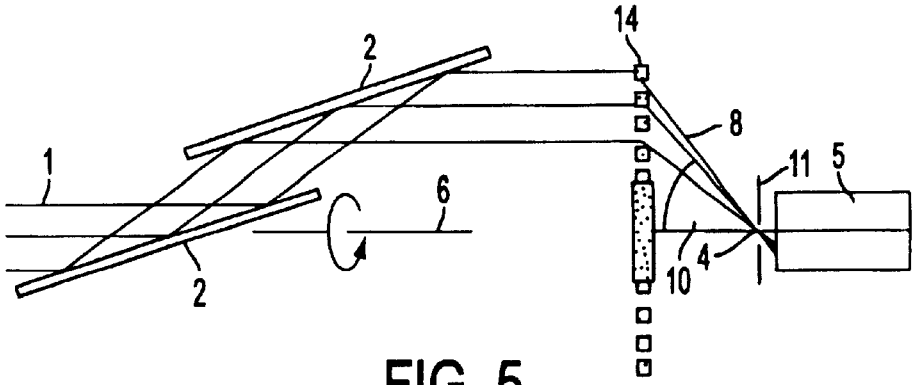
FIG. 5 shows a condenser-monochromator comprising a condenser zone plate and two upstream plane mirrors.

Represented in FIG. 5 is an exemplary embodiment in which an annular condenser zone plate 14 described in the introduction is used as diffracting element. Located upstream thereof in the beam path for the purpose of beam deflection are two plane mirrors 2 which are rotated once about the optical axis 6 by means of a rotatable mechanical holder during the exposure time of an X-ray microscope image, with the result that the deflected beam sweeps once over the entire annular condenser zone plate 14. The condenser zone plate 14 therefore need not be rotated. The illuminating cone 8, incident obliquely on the object 4, describes a hollow cone which determines the effective aperture of the illumination.

Figure 6:
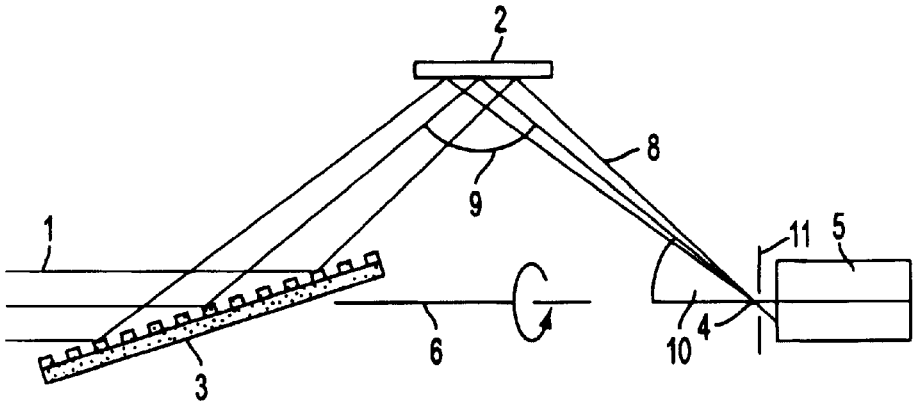
FIG. 6 shows a condenser-monochromator comprising an off-axis reflecting zone plate and a downstream plane mirror.

FIG. 6 represents a condenser-monochromator arrangement in which the incident X-ray radiation 1 impinges on an off-axis reflecting zone plate 3 which diffracts the X-ray radiation 1 by reflection and simultaneously focuses it. The plane mirror 2 deflects the diffracted X-ray radiation onto the object 4. In this process, the off-axis reflecting zone plate 3 and the plane mirror rotate about the optical axis 6. The method of functioning has already been set forth in detail in the description of FIG. 1.

Figure 7A:
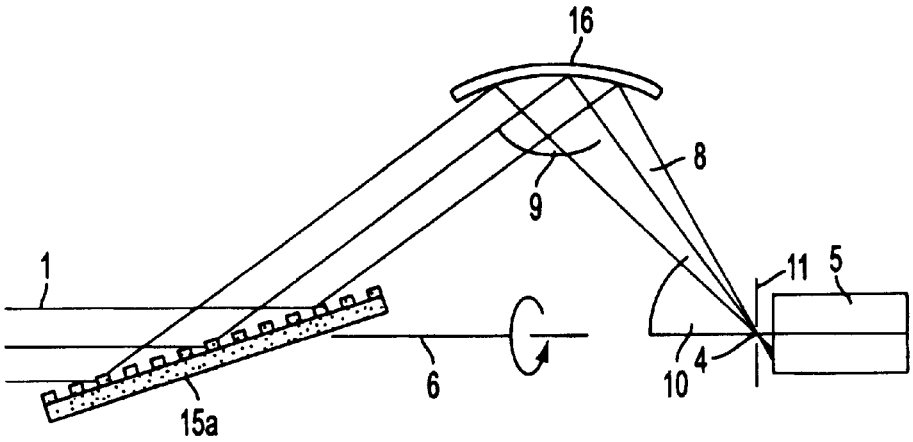
FIG. 7*a* shows a condenser-monochromator comprising a reflecting plane grating and a downstream focusing mirror.

FIG. 7*a* represents an exemplary embodiment in which a plane reflecting grating 15*a* with a variable line density is used as diffracting element. The line density of the plane reflecting grating 15*a* varies in such a way that after diffraction at the plane reflecting grating 15*a* the X-ray radiation has the same beam divergence as upstream of the plane reflecting grating 15*a*. This technique is generally known and is already in use. According to the invention, however, a focusing mirror 16 is additionally arranged in the further beam path and is rotated about the optical axis 6 together with the plane reflecting grating 15. The focusing mirror 16 focuses the X-ray radiation onto the object 4, a hollow cone determining the aperture of the illumination being formed by the rotation.

It is, of course, also possible—given the use of suitable shortwave X-ray radiation—to use a crystal with Bragg reflection instead of the plane reflecting grating 15.

Figure 7B:
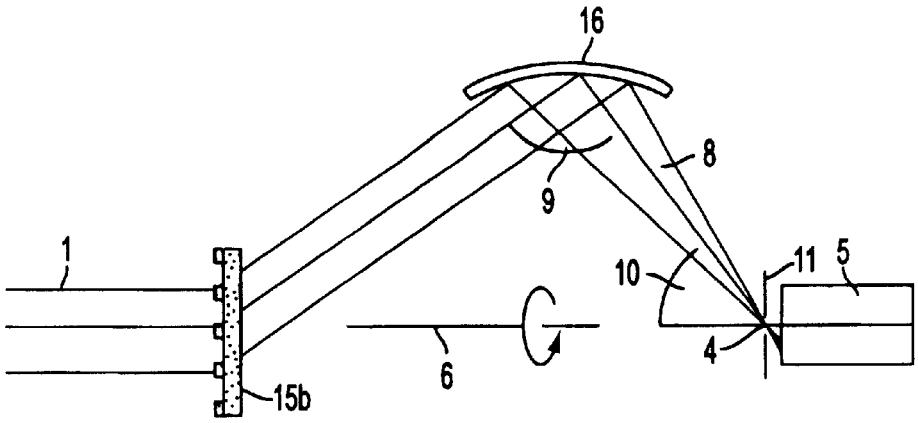
FIG. 7*b* shows a condenser-monochromator comprising a transmitting plane grating and a downstream focusing mirror.

FIG. 7*b* differs from FIG. 7*a* only in that instead of the plane reflecting grating 15*a* a plane transmitting grating 15*b* is used as diffracting optical element. The plane transmitting grating 15*b* diffracts the incident X-ray radiation 1 by transmission and maintains the parallelism of the latter even after diffraction. It is the focusing mirror 16, which rotates together with the plane transmitting grating about the optical axis 6, which first focuses the X-ray radiation onto the object 4.

Figure 8:
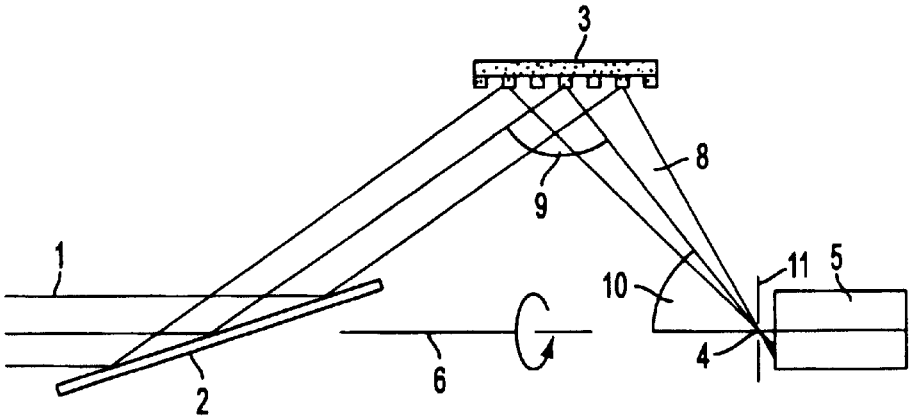
FIG. 8 shows a condenser-monochromator comprising an off-axis reflecting zone plate and an upstream plane mirror.

FIG. 8 shows a condenser-monochromator arrangement with an off-axis reflecting zone plate 3 and a downstream plane mirror 2. The off-axis reflecting zone plate 3 focuses the X-ray light obliquely back to the object 4 onto the optical axis 6. The off-axis reflecting zone plate 3 and the upstream plane mirror 2 are rotated one revolution about the optical axis 6 during the exposure time of the X-ray microscope 5. The illuminating cone 8, which is incident obliquely on the object, describes a hollow cone which determines the effective aperture of the illumination. However, flexible aperture matching is no longer possible with this arrangement.

Given the use of suitably shortwave X-ray radiation, it is, of course, also possible to use a crystal with Bragg reflection instead of the plane mirror 2 in FIG. 8.

Likewise, given the use of suitably shortwave X-ray radiation it is also possible to make use, instead of the off-axis reflecting zone plate 3 in FIG. 8, of a curved crystal in the so-called "Rowland arrangement" and employing Bragg reflection.

The condenser-monochromator arrangements in accordance with FIG. 9 and FIG. 10 having in each case two plane mirrors 2 and an off-axis reflecting zone plate 3, which rotate about the optical axis 6, are already described by analogy in the text relating to FIG. 2 and FIG. 3.

It remains to mention that these solutions found to date with transmitting and reflecting zone plates 7, 3 are also suitable for radiation of longer wavelengths, for example for UV radiation and visible radiation. In particular, said rotating optics can be used to produce an object illumination for incoherent imaging even with coherent light sources, for example in the case of illumination with lasers. Corresponding systems are denoted as systems with "dynamic coherent aperture". They incorporate, moreover, the special case of a strongly oblique and rotating illumination. For the latter, it is known in the visible spectral region that, given high spatial frequencies, the transmission function is distinctly increased by contrast with virtually incoherent illumination with a condenser having a circular pupil, with the result that an improved frequency response is achieved. In the case of the use of monochromatic laser radiation, it is, of course, sufficient to undertake the beam deflection only by means of mirrors, that is to say in FIG. 6 and in FIGS. 8–10 it is possible to dispense with the monochromatizing properties of the off-axis reflecting zone plate 3 and to replace the latter by a focusing mirror. For the same reason, it is then possible in FIGS. 1–4 to replace the off-axis transmitting zone plate 7 by a lens which is used in a segment far removed from the middle of the lens.

Figure 11:
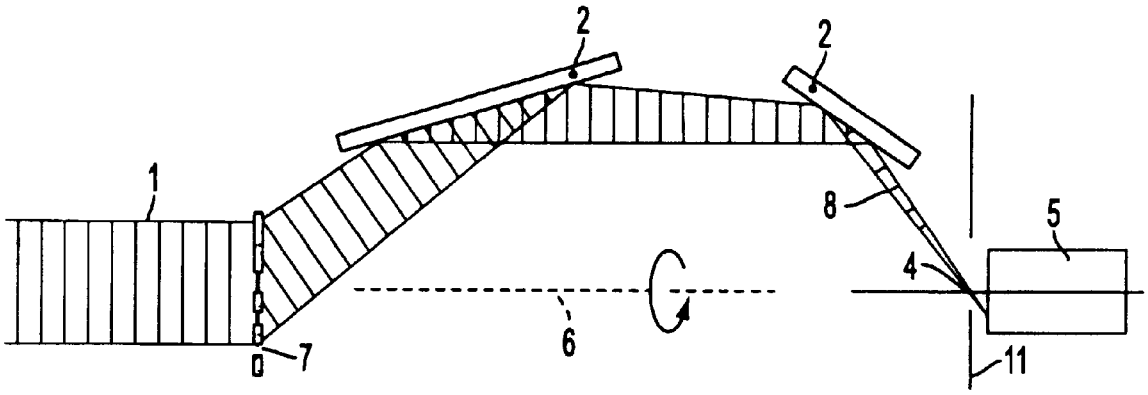
FIG. 11 shows a condenser-monochromator comprising an off-axis transmitting zone plate and two downstream plane mirrors.

The plane mirror 2 shown in FIG. 1, for example, is replaced in FIG. 11 by two consecutive individual plane mirrors 2. However, it is also possible for the two plane mirrors 2 to deflect the X-ray radiation in opposite directions. An arrangement with two consecutive plane mirrors 2 rotating about the optical axis 6 (as these are also represented in FIG. 3 and FIG. 10) has the effect in any case that the image of the X-ray radiation source is not rotated despite a rotating off-axis transmitting zone plate 7 and the rotating plane mirrors 2. This has the advantages discussed further below in the case of the use of elliptical radiation sources, and it is possible to reduce the requirements placed on the accuracy of the play of the rotation axis of the holder for the mirrors and zone plate.

Figure 12:
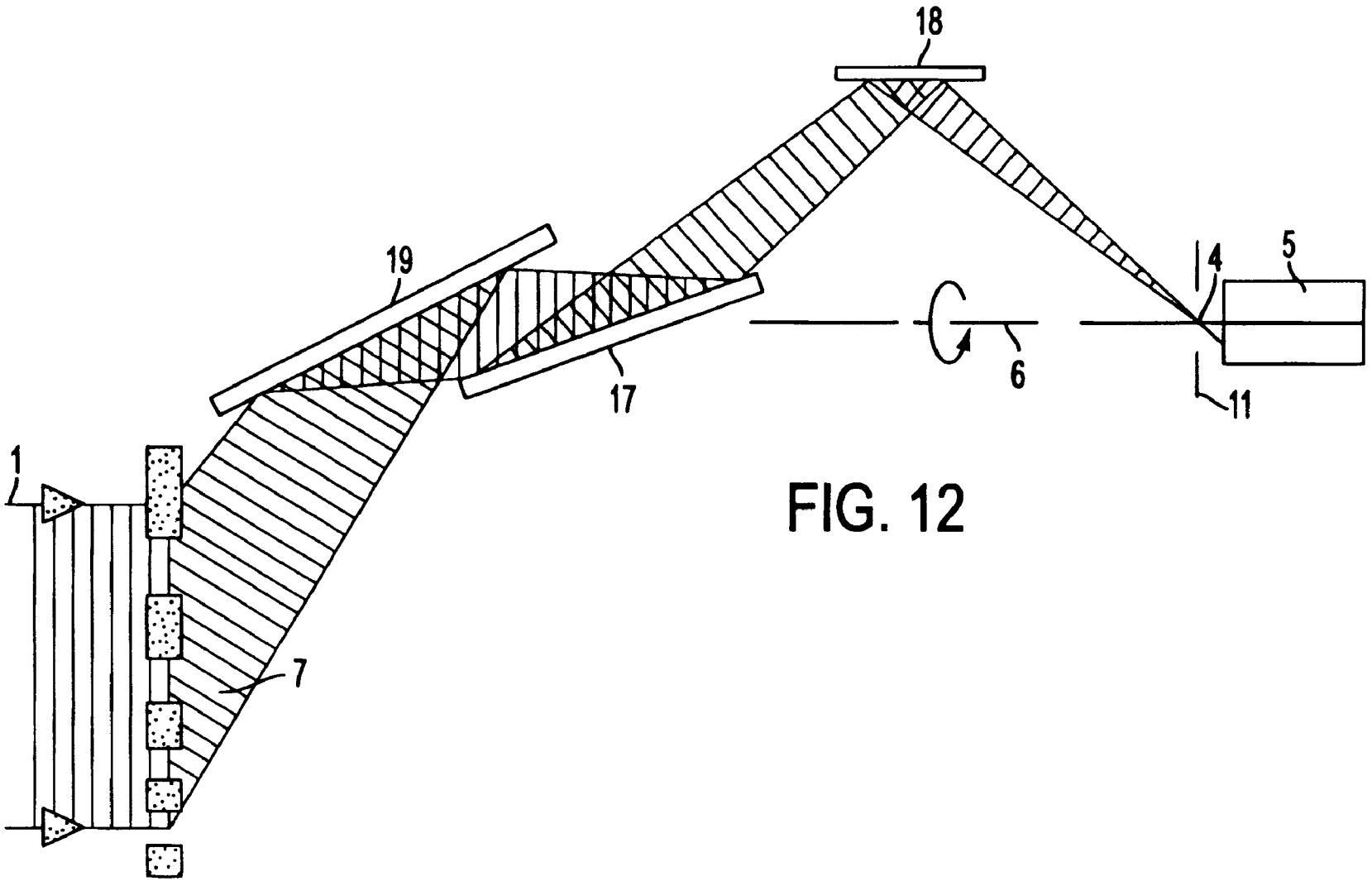
FIG. 12 shows a condenser-monochromator comprising an off-axis transmitting zone plate and three downstream plane mirrors.

Shown in FIG. 12 is a condenser-monochromator comprising an off-axis transmitting zone plate 7 and three downstream plane mirrors 17, 18, 19. In this arrangement, it is only the two downstream plane mirrors 17, 18 which need to rotate about the optical axis 6 of the X-ray microscope 5. The off-axis transmitting zone plate 7 and the plane mirror 19 can remain fixed in space in this case. Said arrangement has the advantage that the image of the X-ray radiation source produced by the off-axis transmitting zone plate 7 is not rotated, by virtue of the twofold reflection at the rotating mirrors 17, 18. If an electron beam undulator is used as X-ray radiation source, said undulator generally has a strongly elliptical source region of which the off-axis transmitting zone plate 7 produces an image. The dispersion direction of the off-axis transmitting zone plate 7 can be positioned such that it coincides with the direction of the ellipse semiminor axis. In this case, the only slightly curved zones of the off-axis transmitting zone plate 7 extend essentially "parallel" to the ellipse semimajor axis of the image. Since, as a consequence of two-fold reflection at the two rotating, downstream mirrors 17, 18, the image of the X-ray radiation source does not rotate, it is therefore possible in this way to produce a relatively homogeneously illuminated "band" of the width of the large diameter of the image ellipse, whose intensity varies only slowly in the direction of dispersion.

At the same time, said arrangement is relatively insensitive to tilting and translation of the rotation axis of the mirror arrangement, since two rotating plane mirrors 2 are used.

Figure 13:
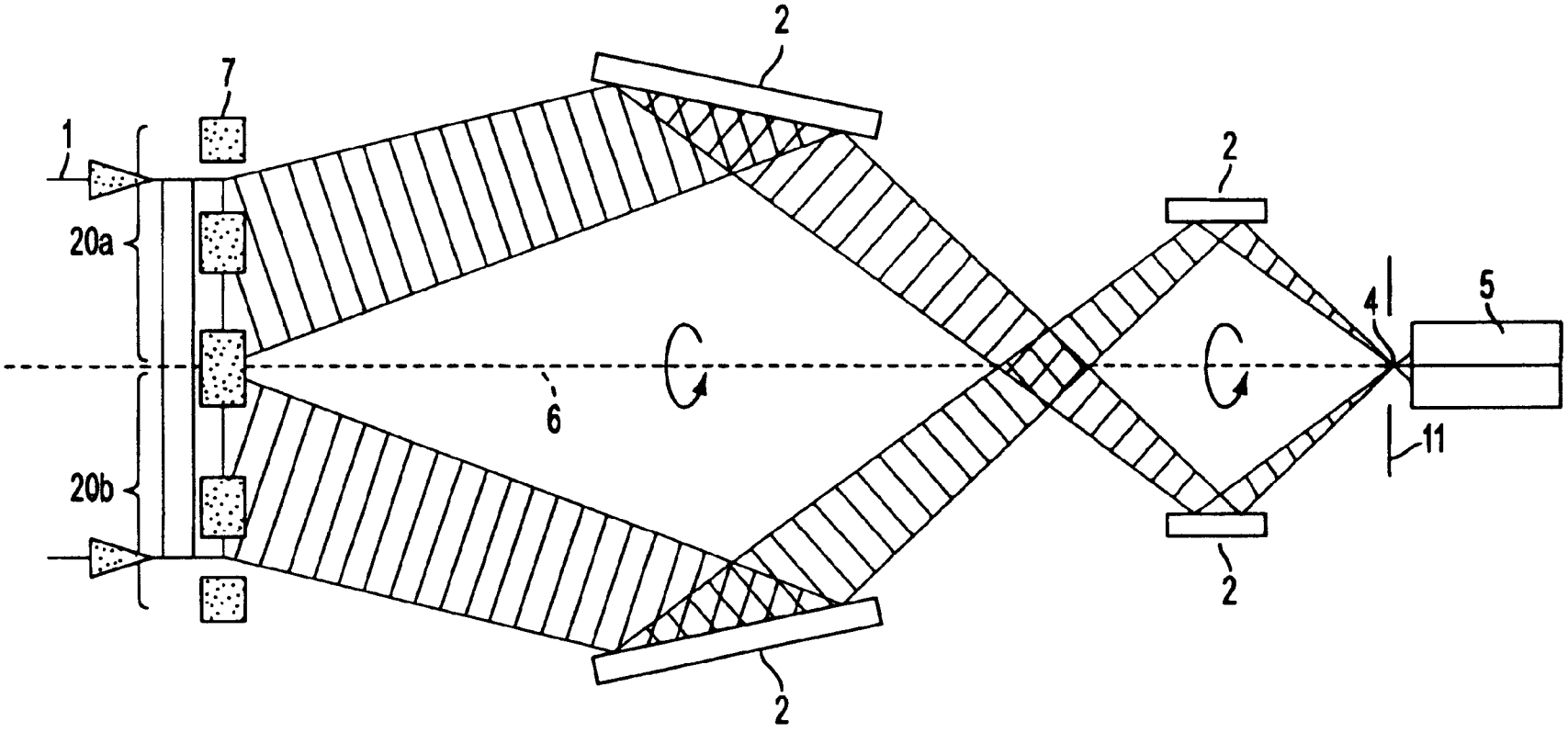
FIG. 13 shows a condenser-monochromator which includes an off-axis transmitting zone plate, made from two segments of differing focal points, and two pairs of plane mirrors.

FIG. 13 shows a condenser-monochromator arrangement with an off-axis transmitting zone plate 7 which is subdivided into two off-axis transmitting zone plate segments 20*a*, 20*b* and with two pairs of downstream plane mirrors 2 deflecting in opposite directions in each case. Here, the X-ray radiation of two of axis transmitting zone plate segments 20*a*, 20*b* of the same focal length is captured. The off-axis transmitting zone plate segments 20*a*, 20*b* are identical in their structure but rotated by 180° relative to one another, with the result that the two associated foci are situated opposite one another, symmetrically relative to the optical axis 6. Each pair of plane mirrors retroreflects the beams onto the optical axis 6, with the result that the two focal points overlap in the object 4. This type of illumination is strictly mirror-symmetric and leads to other imaging properties than the "monolateral imaging" in the case of monolateral and extreme bright-field oblique illumination. In particular, dark-field microscopy can be operated in the image plane with this type of illumination given further enlargement of the angle of illumination. There are then always present in the image plane beams diffracted in a complimentary fashion which can interfere with one another. This is a necessary precondition if the aim is to achieve the limiting resolution in the dark field. In the case of the exemplary embodiment in accordance with FIG. 13, several beam-deflecting optical elements rotate with the off-axis transmitting zone plate 7 and the two pairs of plane mirrors 2 about the optical axis 6. This is also the case for the exemplary embodiment shown in FIG. 14.

Figure 14:
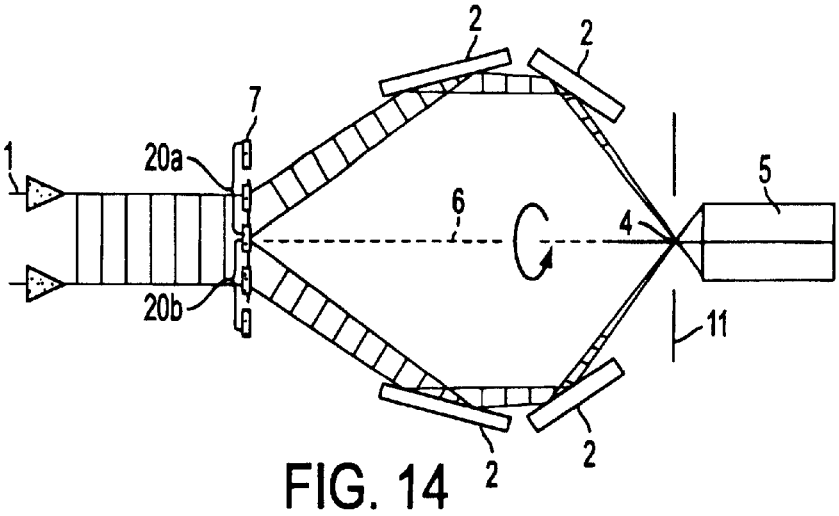
FIG. 14 shows a condenser-monochromator which includes an off-axis transmitting zone plate, made from two segments of differing focal points, and two pairs of plane mirrors.

Represented in FIG. 14 is a condenser-monochromator arrangement with an off-axis transmitting zone plate 7 and with two pairs of plane mirrors 2 which in each case deflect in the same direction. The off-axis transmitting zone plate 7 is assembled, like that in accordance with FIG. 13, from two segments 20*a*, 20*b* which have the same focal length but—in relation to the optical axis 6—opposite focal points. However, because of the radiation-deflecting plane mirrors 2 the otherwise separate focal points overlap at a focal point in the object 4. The principle of the method of functioning is the same as already described with reference to FIG. 13.

Figure 15:
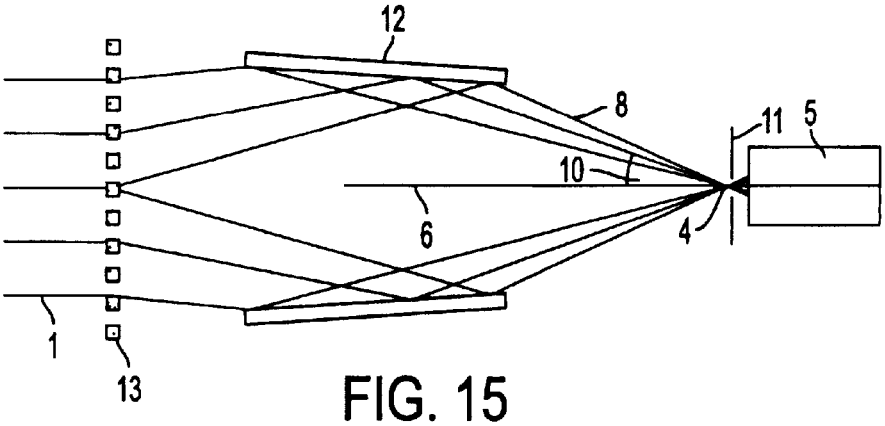
FIG. 15 shows a condenser-monochromator comprising a focusing device with a focusing ring and a downstream hollow conical mirror.

Finally, in accordance with FIG. 15 it is also possible to specify equivalent systems, satisfying the object set, for quasimonochromatic object illumination with incoherent imaging, which do not require rotation of the entire system about the optical axis 6 during the exposure time of an image. As is generally customary in optical microscopy, in this case use is made of a condenser-monochromator which produces an illuminating wave of high numerical aperture. A particular diffracting element with a downstream mirror can be used for this purpose. The diffracting element is a so-called focusing device 13 with a focusing ring which instead of a focal point produces a sharply focused ring concentric with the optical axis 6. Such focusing devices 13 can be produced just like off-axis zone plates 7, 3 with the aid of electron beam lithography. They have very similar parameters and regularities to the off-axis zone plates 7, previously described, with transmission, in particular they need only to have comparatively "coarse" diffracting structures as in the cases described above. A further advantage of the focusing device 13 consists in that it is well suited for strongly collimated radiation. All radiation from the central beam is diffracted and focused by the focusing device 13 into a ring of relatively large diameter which is concentric with the optical axis 6 (FIG. 15). The following mirror system comprises one or two hollow conical mirrors 12 arranged one downstream of another. Said system is arranged at a suitable spacing downstream of the focusing device 13 and upstream of the focusing ring. As a result, instead of a focusing ring a punctiform focus is obtained on the optical axis 6. If a small pinhole diaphragm 11 is placed around said "focal point", the arrangement composed of focusing device 13, hollow conical mirror 12 and pinhole diaphragm 11 acts as a monochromator. The aperture matching is performed via a suitable choice of the deflecting angle of the hollow conical mirror system.

Figure 16:
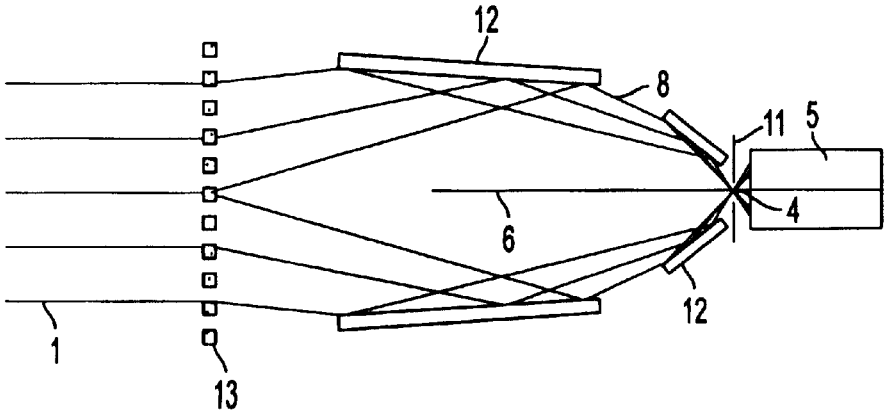
FIG. 16 shows a condenser-monochromator comprising a focusing device with a focusing ring and two downstream hollow conical mirrors.

FIG. 16 shows a condenser-monochromator arrangement having a focusing device 13 with focusing ring and two downstream hollow conical mirrors 12. The advantage of a system with two hollow conical mirrors 12 resides in the fact that in such a system the so-called "break-surface" of the radiation deflection is situated virtually perpendicular to the optical axis 6 (the break-surface being that surface on which the beams extended in the beam direction and the reflected beams extended backwards intersect). It is known the [sic] in optical systems the aberrations which occur in the case of tilting of the system—that is to say, for example, in the case of efficient adjustment—are smaller than in systems whose break-surface extends virtually parallel to the optical axis 6. The latter is the case when a system is used with only one hollow conical mirror 12 for which the reflecting surface and the break-surface must coincide, and which must be adjusted very much more accurately.

The advantages of the invention are summarized once more below. It is possible using a single construction to match the apertures to all previously available microscope zone plates for bright-field, phase-contrast and dark-field microscopy. The aperture of an annular pupil is obtained by rotation of an oblique illumination by 360°, it being possible to set the angle of the oblique illumination over a wide range via a plane mirror 2. The plane mirror 2, for example is very small, typically a few cm long, and therefore cost-effective. No beam expansion is required for operation using well collimated beams from undulators. The wavelength can be varied in very wide ranges. The condenser-monochromator arrangement includes an off-axis zone plate 7, 3 with zone widths which are distinctly larger and thus lighter and quicker to produce than those of the available microscope zone plates which are used as X-ray objective. The wavelength can be varied in very wide ranges. As an alternative, an annular pupil can also be produced by a focusing device 13, a hollow conical mirror 12 then being used to focus the radiation onto the optical axis 6.

List of Reference Numerals

1 Incident X-ray radiation
2 Plane mirror
3 Off-axis reflecting zone plate
4 Object
5 X-ray microscope
6 Optical axis of the X-ray microscope
7 Off-axis transmitting zone plate
8 Obliquely incident illuminating cone
9 Angle of reflection
10 Half aperture angle of the hollow conical illumination
11 Monochromator pinhole diaphragm in the object plane
12 Hollow conical mirror
13 Focusing device with focusing ring
14 Annular condenser zone plate
**15*a*** Plane reflecting grating
**15*b*** Plane transmitting grating
16 Focusing mirror
17 Plane mirror
18 Plane mirror
19 Plane mirror
**20*a*** Off-axis zone plate segment
**20*b*** Off-axis zone plate segment

What is claimed is:

1. Condenser-monochromator arrangement for X-ray radiation for quasimonochromatic illumination and incoherent imaging of an object (4) in an X-ray microscope (5) with beam-deflecting optical elements and with a monochromator pinhole diaphragm (11) arranged on the optical axis (6) of the X-ray microscope (5), characterized in that there are provided as optical elements for illumination of the object an off-axis zone plate (3; 7) and at least one plane mirror (2, 17, 18) which are mounted rotatably about the optical axis (6) of the X-ray microscope (5).

2. Condenser-monochromator arrangement for X-ray radiation according to claim 1, characterized in that at least one plane mirror (2) is arranged in the beam path at one of an upstream and a downstream location relative to the off-axis zone plate (3; 7).

3. Condenser-monochromator arrangement for X-ray radiation according to claim 1, characterized in that a plane mirror (2) is arranged in each case in the beam path upstream or downstream of the off-axis zone plate (3; 7).

4. Condenser-monochromator arrangement for X-ray radiation according to claim 1, characterized in that the off-axis zone plate (3; 7) is one of a transmitting zone plate (7) and a reflecting zone plate (3).

5. Condenser-monochromator arrangement for X-ray radiation for quasimonochromatic illumination and incoherent imaging of an object (4) in an X-ray microscope (5) with beam-deflecting optical elements and with a monochromator pinhole diaphragm (11) arranged on the optical axis (6) of the X-ray microscope (5), characterized in that there are provided as optical elements for illumination of the object a grating and a focusing mirror (16) which are mounted rotatably about the optical axis (6) of the X-ray microscope (5).

6. Condenser-monochromator arrangement for X-ray radiation according to claim 5, characterized in that the grating is one of a plane reflection grating (15*a*) and a plane transmission grating (15*b*).

7. Condenser-monochromator arrangement for X-ray radiation according to claim 5, characterized in that the grating is a crystal which is used with Bragg reflection.

8. Condenser-monochromator arrangement for X-ray radiation according to claim 5, characterized in that the focusing mirror (16) is a curved crystal which is used in a Rowland arrangement.

9. Condenser-monochromator arrangement for X-ray radiation for quasimonochromatic illumination and incoherent imaging of an object (4) in an X-ray microscope (5) with beam-deflecting optical elements and with a monochromator pinhole diaphragm (11) arranged on the optical axis (6) of the X-ray microscope (5), characterized in that there are provided as optical elements for illumination of the object at least one plane mirror (2) rotatable about the axis (6) of the X-ray microscope (5) and a fixed condensor zone plate (14) arranged in the beam path upstream of the monochromator pinhole diaphragm (11), the plane mirror (2) directing the X-ray radiation (1) incident on it onto the condensor zone plate (14).

10. Condenser-monochromator arrangement for X-ray radiation according to claim 9, characterized in that arranged offset parallel to one another are two plane mirrors (2) which rotate about the axis (6) of the X-ray microscope (5) and direct the incident X-ray radiation (1) in a fashion offset parallel to the optical axis (6) onto the condenser zone plate (14).

11. Condenser-monochromator arrangement for X-ray radiation for quasimonochromatic illumination and incoherent imaging of an object (4) in an X-ray microscope (5) with beam-deflecting optical elements and with a monochromator pinhole diaphragm (11) arranged on the optical axis (6) of the X-ray microscope (5), characterized in that there are provided as optical elements for illumination of the object a diffracting focusing device (13) with a focusing ring and at least one hollow conical mirror (12) downstream in the beam path, wherein the diffracting focusing device (13) is arranged on the optical axis (6) of the X-ray microscope (5) to diffract and focus a central beam.

* * * * *